US009190728B2

(12) United States Patent
Cheng et al.

(10) Patent No.: US 9,190,728 B2
(45) Date of Patent: Nov. 17, 2015

(54) OMNIDIRECTIONAL ANTENNA

(71) Applicant: ARCADYAN TECHNOLOGY CORPORATION, Hsinchu (TW)

(72) Inventors: Shih-Chieh Cheng, Kaohsiung (TW); Kuo-Chang Lo, Miaoli County (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 179 days.

(21) Appl. No.: 14/040,560

(22) Filed: Sep. 27, 2013

(65) Prior Publication Data

US 2014/0191918 A1 Jul. 10, 2014

Related U.S. Application Data

(60) Provisional application No. 61/749,437, filed on Jan. 7, 2013.

(51) Int. Cl.

| | |
|---|---|
| ***H01Q 5/01*** | (2006.01) |
| ***H01Q 1/48*** | (2006.01) |
| ***H01Q 21/20*** | (2006.01) |
| ***H01Q 5/10*** | (2015.01) |

(Continued)

(52) U.S. Cl.

CPC . *H01Q 5/01* (2013.01); *H01Q 1/48* (2013.01); *H01Q 5/10* (2015.01); *H01Q 21/205* (2013.01); *H01Q 1/2291* (2013.01); *H01Q 9/42* (2013.01)

(58) Field of Classification Search

CPC ..... H01Q 5/10; H01Q 1/48; H01Q 9/42; H01Q 21/205

USPC ..... 343/834, 700 MS

See application file for complete search history.

(56) References Cited

U.S. PATENT DOCUMENTS

| | | | | |
|---|---|---|---|---|
| 6,344,823 | B1 * | 2/2002 | Deng | 343/700 MS |
| 7,450,072 | B2 * | 11/2008 | Kim et al. | 343/700 MS |
| 2004/0070537 | A1 | 4/2004 | Kadambi et al. | |

(Continued)

FOREIGN PATENT DOCUMENTS

| | | | |
|---|---|---|---|
| CN | 101443957 | A | 5/2009 |
| CN | 100570950 | C | 12/2009 |

(Continued)

OTHER PUBLICATIONS

European Patent Office, Search Report issued on Apr. 29, 2014.

*Primary Examiner* — Hoang V Nguyen

(74) *Attorney, Agent, or Firm* — Li & Cai Intellectual Property (USA) Office

(57) ABSTRACT

Disclosure is related to an omnidirectional antenna. Structurally the antenna includes multiple antenna units which are oppositely disposed around the edges of a grounded substrate. The antenna is able to handle at least two bands of electromagnetic signals. The body of each antenna unit includes a radiating member which is extended from an inverse-F portion type structure at the upper half of the body. A downward-protrudent feeding member is formed at the middle portion of the radiating member. A connecting member electrically connected to the substrate is formed at the lower half of the body, and associated with the radiating member. At least two upward-protrudent grounding members are formed onto the connecting member. The grounding members are jointly grounded with the substrate. It is noted that the feeding member is extended in the midst of the two grounding members. The opposite antenna units are mutually served be reflectors.

12 Claims, 16 Drawing Sheets

(51) Int. Cl.
*H01Q 1/22* (2006.01)
*H01Q 9/42* (2006.01)

(56) References Cited

U.S. PATENT DOCUMENTS

| | | | |
|---|---|---|---|
| 2004/0257283 | A1 | 12/2004 | Asano et al. |
| 2006/0109184 | A1 | 5/2006 | Chen et al. |
| 2007/0229366 | A1 | 10/2007 | Kim et al. |

FOREIGN PATENT DOCUMENTS

| | | | |
|---|---|---|---|
| CN | 201655979 | U | 11/2010 |
| CN | 102117956 | A | 7/2011 |
| EP | 2048739 | A1 | 4/2009 |
| EP | 2372839 | A1 | 10/2011 |
| WO | WO2004/112187 | A1 | 12/2004 |

* cited by examiner

OMNIDIRECTIONAL ANTENNA

BACKGROUND OF THE INVENTION

1. Field of the Invention

The present invention is related to an omnidirectional antenna, in particular to the antenna including antenna units oppositely disposed on a grounded substrate for achieving omnidirectional radiation.

2. Description of Related Art

Antenna is an essential component for the various electronic devices for transmitting or receiving RF (radio frequency) signals. Antenna is introduced to converting electric power into radio waves for delivery over air. On the other hand, the antenna also converts the radio waves into the electronic signals. While the RF signals are delivered, a radio receiver or transmitter connected with the antenna in the device can convert the energy of radio waves to the signals applicable to the circuit of the device.

The antenna is configured to a specific application according to the required characteristics and performance. The performance specified to the antenna is usually the one of reasons the technical person selects the antenna.

One of the classes of antennas is such as an omnidirectional antenna that radiates radio wave power uniformly in all directions over a whole sky. One further class is such as a directional antenna that only processes the radio waves specified to or from a narrow range of directions. The any antenna may include a reflection unit and a pointing unit, or any plane for guiding the radio waves.

SUMMARY OF THE INVENTION

An omnidirectional antenna, such as a single-frequency antenna or a dual-band antenna, is provided. The antenna is configured to provide a plurality of antenna units oppositely disposed on a grounded substrate. Multiple antenna units are disposed at peripheral region of the substrate. The every antenna unit includes a strip-shaped radiating member formed in an upper half of the antenna unit, and extended from an inverse-F portion. The antenna unit includes a downward-protrudent feeding member formed in a middle portion of the radiating member. The antenna unit further includes a connecting member formed in a lower half of the antenna unit, being a member interconnecting the antenna unit and the substrate, and connected with the radiating member. Still further, the antenna unit includes at least two upward-protrudent grounding member formed on the connecting member, and jointly grounded with the substrate through the connecting member, wherein the feeding member is extended to a portion between the two grounding members.

In an exemplary embodiment, the radiating member, the feeding member, the connecting member, and the at least two grounding members of the antenna unit are substantially coplanar. The antenna unit also includes one or more matching members for tuning impedance match. The antenna unit is substantially perpendicular to the substrate.

The omnidirectional antenna is configured to process the electromagnetic signals in two different frequency bands. There are two types of antenna units that respectively receive and transmit the electromagnetic waves under the two frequency bands. In particular, the plurality of antenna units are oppositely disposed at the two sides of the substrate. The oppositely disposed antenna units are mutually served as reflectors in pairs.

In one further embodiment, the omnidirectional antenna includes a grounded substrate, antenna units operating in a first frequency band around 2.4 GHz, and antenna units operating in a second frequency band around 5 GHz. The two sets of antenna units are alternately disposed on the substrate, and the opposite antenna units are served as reflectors mutually.

In one further embodiment, the omnidirectional antenna includes a substrate, antenna units extended from the peripheral region of the substrate, at least one antenna unit operative for the first frequency band around 2.4 GHz electromagnetic waves, and antenna unit operative for the second frequency band around 5 GHz electromagnetic waves. And second set of antenna units are alternately disposed among the antenna units operating in the second frequency band. The shape of substrate may be symmetric square, hexagon, or octagon. The antenna units are oppositely disposed in pairs for being mutual reflectors.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

For providing an omnidirectional antenna, disclosure herein is related to an antenna composed of multiple antenna units in accordance with the present invention. Those antenna units are commonly coupled to a grounded plane substrate. A one-piece manufacturing process is introduced to forming the minimized, low-cost, and omnidirectional antenna.

In an exemplary embodiment, the omnidirectional antenna includes the antenna units formed by at least one configuration. The multiple antenna units are oppositely disposed. Thus, in addition to the every antenna unit irradiating RF signals in a specific frequency band, the units are mutually served as reflectors. A uniform radiation may be generated. The antenna may be adapted to non-directional communication system such as WiFi™.

Figure 1:
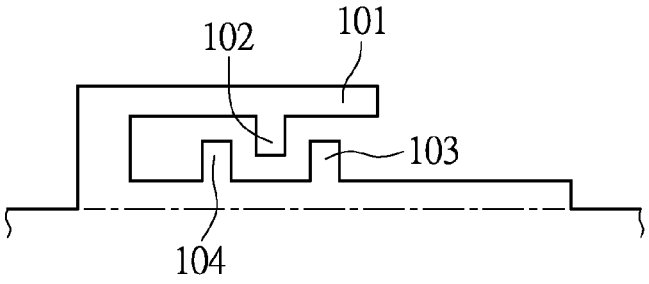
FIG. 1 shows a schematic diagram depicting an omnidirectional antenna in one embodiment of the present invention.

Reference is made to FIG. 1 depicting the antenna units within an omnidirectional antenna. In one of embodiments, the antenna units are the essential elements for irradiating or reflecting the signals of the omnidirectional antenna. The body of antenna unit essentially includes an inverse-F metal component. The upper half of the structure includes a strip-shaped first radiating member 101 extended from an inverse-F portion. The first radiating member 101 is as a resonator that is used to irradiate radiation. A downward-protrudent first feeding member 102 is formed in a middle portion of the first radiating member 101. This protrudent first feeding member 102 is a terminal for receiving signals and may be strip-shaped or not limited to any shape and electrically connected with an inner circuit.

In the diagram, the lower half of the antenna unit is configured to have a strip-shaped component which is a little longer than the connecting member of the radiating member 101. The connecting member is connected with the radiating member 101 and the substrate (not shown in this diagram) of the whole omnidirectional antenna. At least two protrudent grounded ends are formed in the middle portion of the connecting member, such as the two first grounding members 103 and 104. It is noted that the first grounding members 103 and 104 are not limited to any specific shape. In the present example, the grounding members 103, 104 are shown as the strip-shaped components which are respectively disposed at two opposite sides. The grounding members 103, 104 are jointly grounded with the substrate of the whole antenna via the connecting member. This structure may protrude at two sides of the first feeding member 102. In other words, the feeding member 102 is formed in the middle portion between the two first grounding members 103 and 104. It is noted that, in the present example, the first radiating member 101, the first feeding member 102, the first grounding members 103, 104, and the bottom connecting member are substantially coplanar.

According to one of the embodiments of the present invention, reference is made to FIG. 1, the antenna units of the omnidirectional antenna may process the signals in 5 GHz frequency band.

Rather than the antenna units shown in FIG. 1, another type of antenna units for the omnidirectional antenna is described. In an exemplary embodiment, this type of antenna units may operate in 2.4 GHz frequency band.

Figure 2:
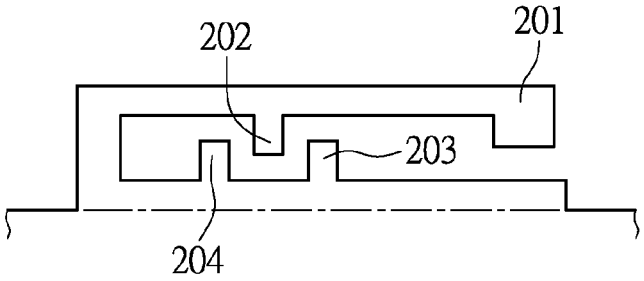
FIG. 2 shows a schematic diagram depicting an omnidirectional antenna in one further embodiment of the present invention.

FIG. 2 illustrates the major elements of the omnidirectional antenna according to one of the embodiments of the present invention. The upper half of the antenna unit appears an inverse-F type of metal component including a second radiating member 201 extended from the main body of the antenna. The second radiating member 201 is as a resonator that is a little different from the afore-mentioned first radiating member 101. A small downward-perpendicular strip-shaped portion is extended at the end of the second radiating member 201. A second feeding member 202 protrudes in the middle portion of the radiating member 201. The second feeding member 202 is, but not limited to, such as a strip-shaped component of the antenna. This second feeding member 202 is as a receiving terminal, through which the inner circuit is electrically connected with the omnidirectional antenna.

Further, the lower half of the antenna unit has a strip-shaped connecting member which is longer or equal to length of the second radiating member 201. This connecting member may connect with the substrate (not shown in this diagram) of the omnidirectional antenna. Further, two protrudent strip-shaped second grounding members 203 and 204 are formed in the middle portion of the connecting member.

These two second grounding members 203 and 204 are respectively disposed at two opposite sides, and jointly grounded to the substrate of antenna through the connecting member. The structure shown in FIG. 2 is similar with the structure described in FIG. 1. The two second grounding members 203, 204 protrude at the two sides of the second feeding member 202, which means the second feeding member 202 is formed between the two second grounding members 203 and 204. This embodiment shows the second radiating member 201, the second feeding member 202, the second grounding members 203, 204 and the bottom connecting member are substantially coplanar.

Figure 3:
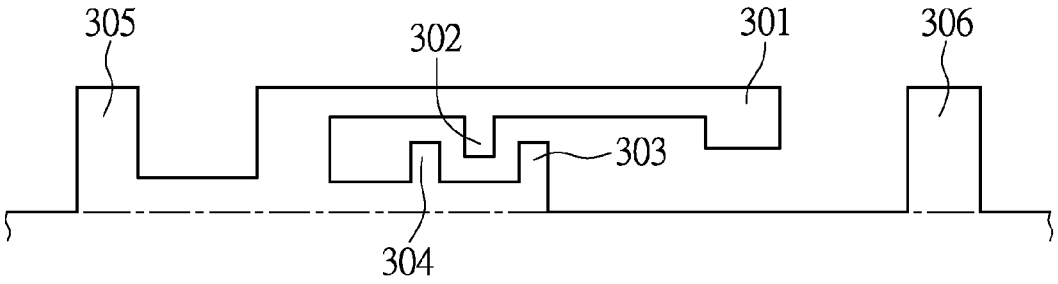
FIG. 3 shows a schematic diagram depicting an omnidirectional antenna in one embodiment of the present invention.

FIGS. 1 and 2 describe the major components of the omnidirectional antenna in accordance with the present invention. The two types of antenna units are respectively processing the electromagnetic signals over two different frequency bands. The references made in the figures are schematically described. The further details of the structure including length, width, relative length, and spaces among the components are adjustable for practical requirements. FIG. 3 shows one further embodiment of the other type of antenna unit.

This antenna unit appears an inverse-F third radiating member 301 extended from the body of antenna. The third radiating member 301 is as a resonator for radiating the electromagnetic waves. A small downward-perpendicular strip-shaped portion is extended from the end of the third radiating member 301. A strip-shaped third feeding member 302 protrudes in the middle portion of the third radiating member 301. The feeding member 302 as a receiving terminal is electrically connected with inner circuit of the omnidirectional antenna.

A strip-shaped connecting member formed at the lower half of the antenna unit is a little shorter than the upper half of third radiating member 301. The connecting member is electrically connected with the substrate (not shown in this diagram) of the whole omnidirectional antenna. Two strip-shaped third grounding members 303 and 304 protrude at the connecting member and are respectively disposed at two sides thereof. Further, the two third grounding members 303, 304 are jointly grounded to the substrate of the antenna through the connecting member. The structure is also similar with the embodiments described in FIG. 1 or FIG. 2. The two third grounding members 303, 304 protrude at two sides of the third feeding member 302, which means the third feeding member 302 is formed between the two grounding members 303 and 304.

Reference is next made to FIG. 3 describing one further embodiment of the present invention. The lower half of antenna unit is connected with the connecting member of the substrate. Further, a matching member 305 is introduced to matching with a specific frequency band and to be disposed at a distance from the antenna unit. The present example shows the matching member is at left side of the antenna unit. The matching member 305 is used to adjust the input impedance for allowing the response of antenna to be complied with a frequency band. The other side, for example the right side, of the antenna unit may be disposed with one further second matching member 306. It is noted that, as required, the one or multiple sides of the substrate may also be disposed with one or more matching members.

This embodiment shows the third radiating member 301, the third feeding member 302, the third grounding members 303, 304, the connecting member and the matching members 305, 306 are substantially coplanar.

Figure 4:
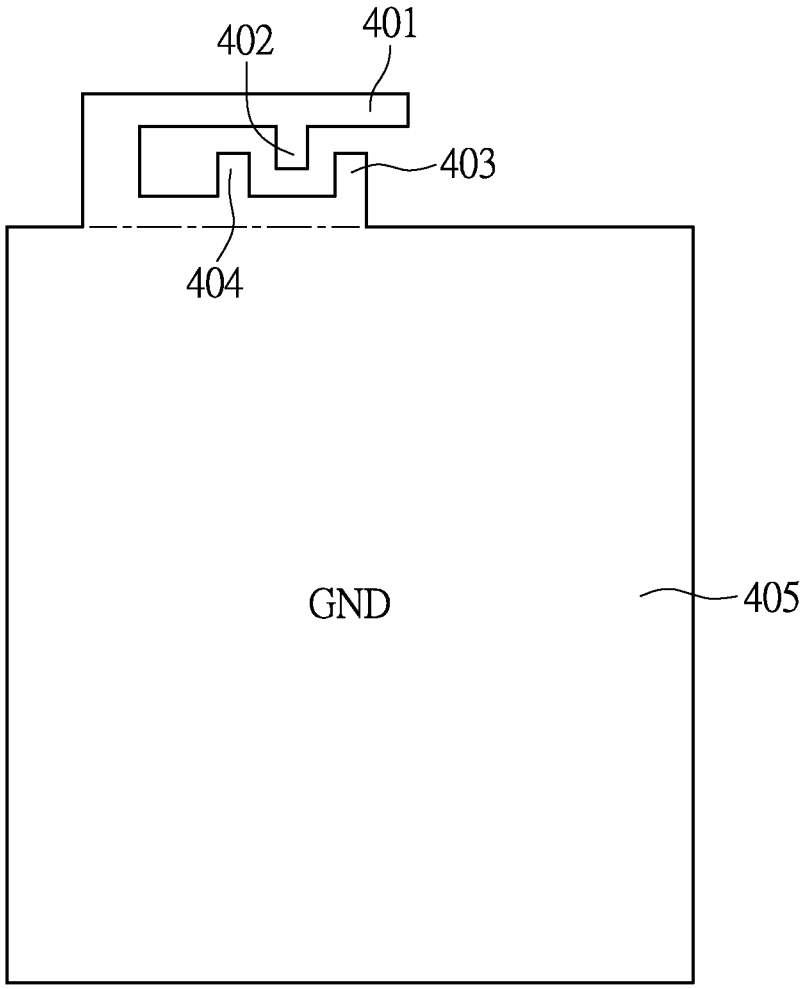
FIG. 4 schematically describes connection between the antenna units and the substrate in one embodiment of the present invention.

FIG. 4 shows a schematic diagram depicting the apparatus having an antenna unit and a grounded substrate. The antenna appears to have one type of the antenna units, e.g. the type described in FIG. 1. The antenna unit is formed at one side of the whole square antenna structure. The substrate 405 may be formed with a one-piece metal plate. In an exemplary example, the metal plate may be made by a molding process at one time. The practical embodiment may not exclude any other process such as assembling the elements when they are separately manufactured.

Further, the antenna unit is configured to have a fourth radiating member 401 as a radiating portion, and extended from the inverse-F antenna. The middle portion of the fourth radiating member 401 forms a fourth feeding member 402 for signaling with the inner circuit. Two protrudent fourth grounding members 403 and 404 are formed at the lower half of the antenna unit. The antenna unit is electrically connected with the grounded substrate 405. It is therefore the fourth grounding members 403, 404 and the substrate 405 are jointly grounded. Similarly, the fourth radiating member 401, the fourth feeding member 402, the fourth grounding members 403, 404 and the portion associated with the substrate 405 are substantially coplanar. Further, these components and the substrate 405 may be formed by a one-piece integration method.

Figure 5:
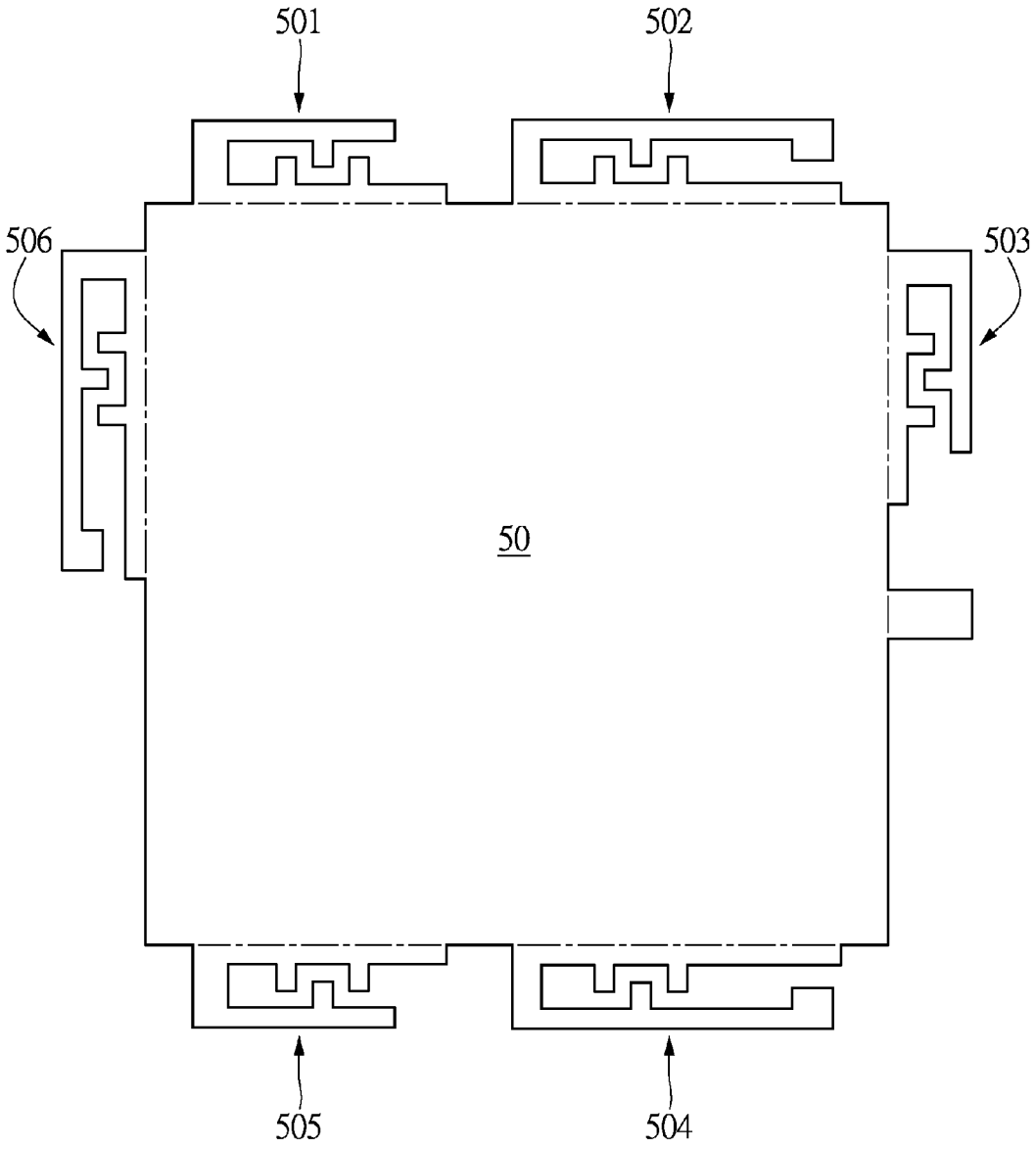
FIG. 5 schematically describes connection between the antenna units and the substrate in one further embodiment of the present invention.

FIG. 5 schematically shows the antenna which is structurally a metal plate on the same plane. The antenna includes multiple antenna units exemplarily including a first antenna unit 501, a second antenna unit 502, a third antenna unit 503, a fourth antenna unit 504, a fifth antenna unit 505, a sixth antenna unit 506, and a grounded substrate 50. For this example, six antenna units are separately disposed at the four sides of this quadrilateral substrate 50. The every side of the substrate 50 may have one or two different antenna units which are respectively used to operate the RF signals over two different frequency bands. The dotted line indicates the bendable portion for this antenna. For example, the bendable portion is such as the perpendicular portion shown in FIG. 6, which schematically depicts the perspective view of the omnidirectional antenna in one embodiment of the present invention.

The omnidirectional antenna structurally includes a ground plane substrate 50, and its peripheral region is disposed with multiple antenna units, wherein some of the units operate the signals around a first frequency band and others may operate over a second frequency band. It is noted that the first frequency band may be around 2.4 GHz, and the second frequency band may be in 5 GHz.

According to one of the embodiments of the present invention, the antenna units for the second frequency band may be alternately positioned among the antenna units for the first frequency band. Reference is made to FIG. 5, the opposite side to the antenna units for the first frequency band may have the units operative for the second frequency band. The opposite units are configured to be mutual reflectors. For example, the antenna unit 501 is the reflector for the opposite antenna unit 505; the antenna units 502 and 504 are mutually served as reflectors; and the antenna units 503 and 506 are also the reflectors for each other.

According to one embodiment, the every antenna unit is characterized in that the basic form thereof is such as an inverse-F type of antenna. The body of antenna unit extends to form a radiating member. The middle portion of the radiating member forms a feeding member and a pair of protrudent grounding members connected with the lower half of substrate 50. The pair of grounding members are respectively formed at both sides around the feeding member, and jointly grounded in particular.

The omnidirectional antenna has the two types of the antenna units disposed around the substrate, and which are shown in FIG. 1, FIG. 2 or FIG. 3. The two types of antenna units operate the RF signals over the at least two different frequency bands. For example, the shown antenna units 501, 503, 505 are the same type of antenna, which are, but not limited to, operating around 5 GHz frequency band. The antenna units 502, 504, 506 are another type of antenna, for example the type described in FIG. 2. The antenna units 502, 504 and 506 are, but not limited to, operating around 2.4 GHz frequency band. Furthermore, a matching component is used to match the antenna structure to fit in with a specific frequency band.

While assembling the two types of antenna units, the polygonal omnidirectional antenna, preferably the antenna with an even-numbered-side plane substrate, for example the mentioned quadrilateral antenna, becomes a dipolar antenna. The dipolar antenna is such as the antenna units 501, 503, 505, which are the same type, orthogonally disposed around the substrate with different side lengths. The antenna units 501, 503, and 505 are coupled with each other.

The one embodiment of the present invention is such as the whole design of the antenna shown in FIG. 5. The unfolded antenna units of the antenna are described in the figure. The design of the antenna units are in compliance with two specific frequency bands. For example, the width of the antenna unit is around 86 mm, the length is around 86 mm, and the height indicative of thickness of the antenna is around 0.8 mm. However, the size of the omnidirectional antenna may not be limited to the described dimensions.

Figure 6:
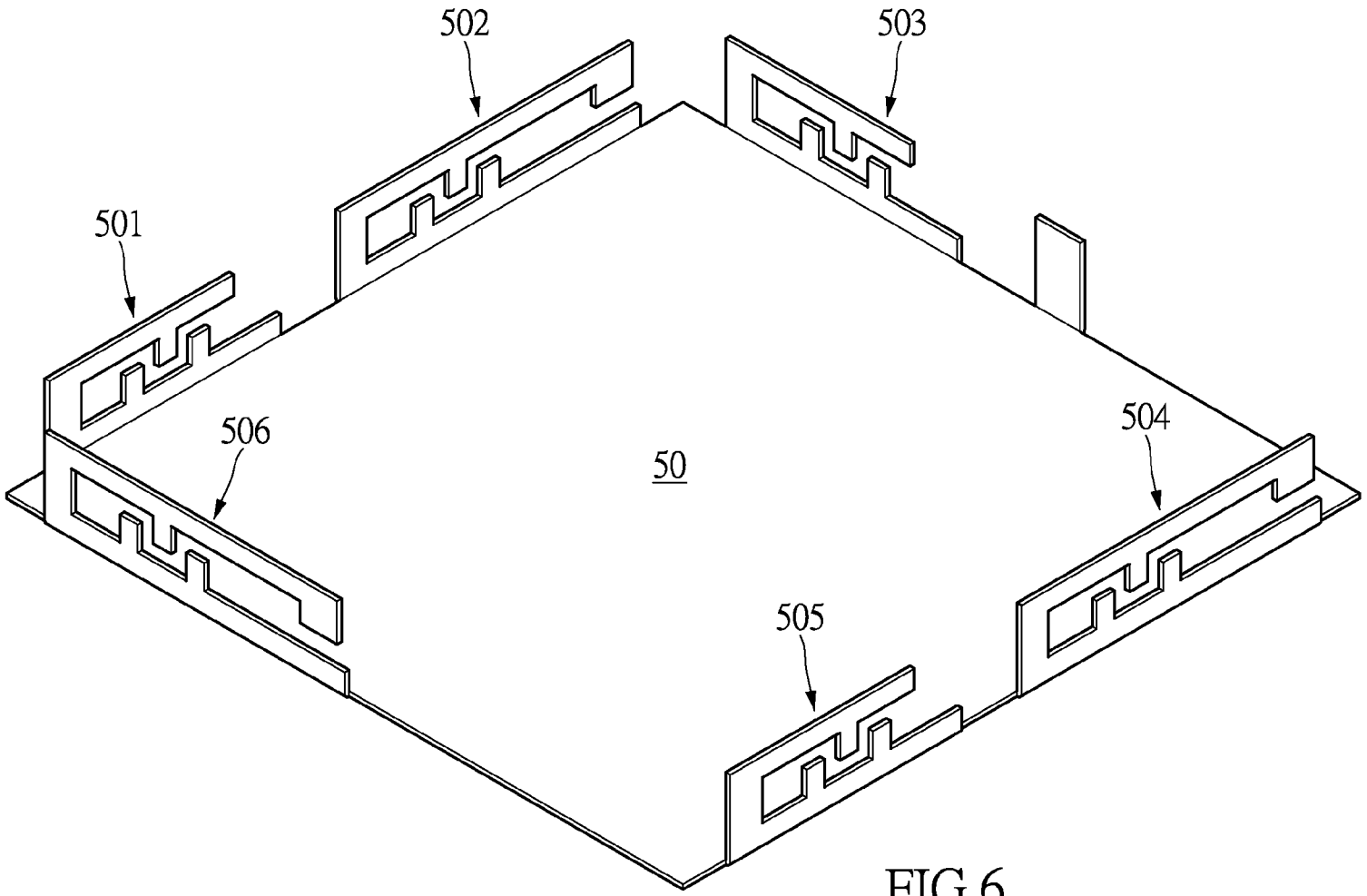
FIG. 6 shows a three-dimensional view of an omnidirectional antenna in one embodiment of the present invention.

Further, the folded antenna units of the antenna are referred to the perspective view of the antenna in FIG. 6.

The example shows the erected antenna units 501, 502, 503, 504, 505 and 506 are substantially perpendicular to the substrate 50. The erected angle may be modified according the practical requirement. The positions of the antenna units may also be adjusted as demands. It is shown that these antenna units 501, 502, 503, 504, 505 and 506 are oppositely disposed in pairs. The opposite pair of units may be different types of antenna units. The folded antenna units render the whole antenna having a height (thickness) of 9 mm, and about 70 mm in width and about 70 mm in length. However, the omnidirectional antenna may not be limited to the dimensions described here.

According to the description of the invention, the antenna units 501, 502, 503, 504, 505 and 506 disposed at the peripheral region are mutually served as reflectors for each other in addition to radiating or receiving RF signals in specific frequency band. For example, the antenna unit 501 serves as a reflector for the opposite antenna unit 505, and vice versa. That means the antenna unit 501 reflects the electromagnetic waves radiated from the antenna unit 505. Therefore, the electromagnetic waves may cover wider space. Similarly, in addition to the radiation the antenna unit 505 operates in a specific frequency band, it still severs as the reflector for the antenna unit 501. Accordingly, the antenna unit 502 is served to radiate the electromagnetic waves and reflect the waves from the antenna unit 504; the antenna units 503 and 506 are mutually served as reflectors for each other.

To the mentioned polygonal substrate, preferably having even-numbered sides, for example the quadrangle, the structure renders the interactions among the multiple antenna units. The interactions allow the antenna to be an omnidirectional antenna that serves radiation signals over near 360-degree space.

Figure 7:
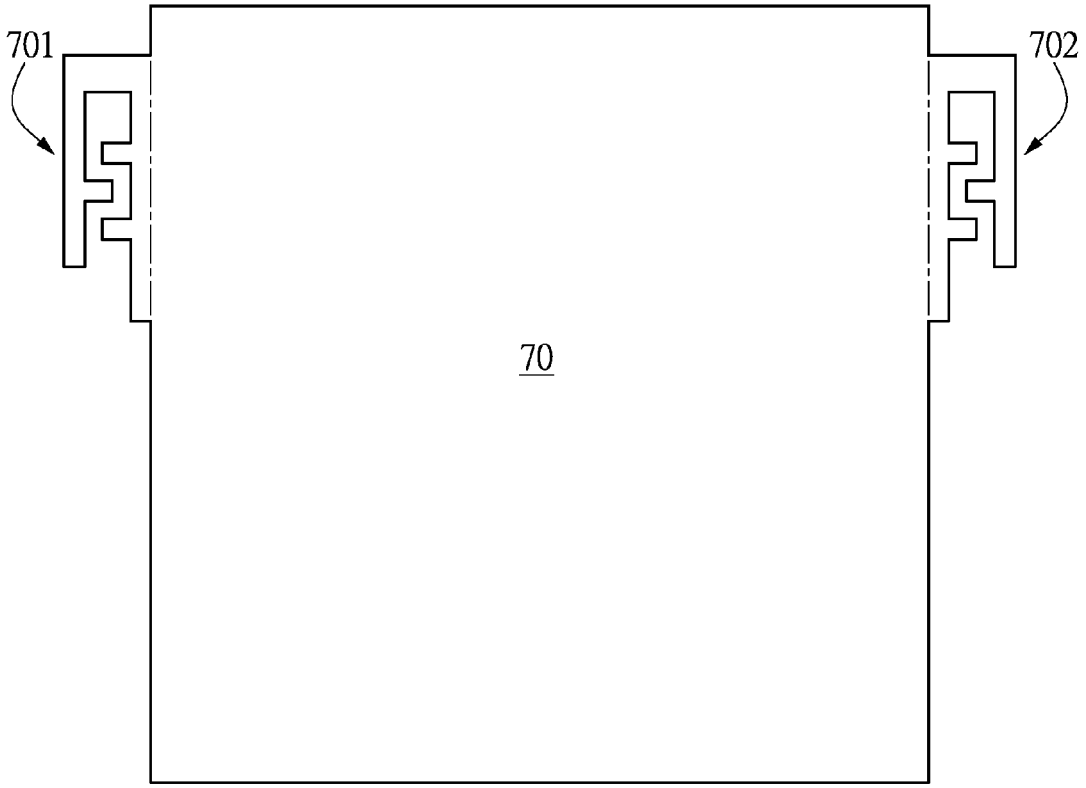
FIG. 7 shows a diagram of the omnidirectional antenna in first embodiment of the present invention.

The embodiment shown in FIG. 7 schematically depicts the omnidirectional antenna substantially composed of a grounded plane substrate 70 and two opposite antenna units. The antenna units 701, 702, in the present embodiment, are coupled with the same types of antenna. The antenna units 701 and 702 are disposed at two opposite sides of the substrate 70. The assembly of antenna units 701 and 702 forms a single-frequency antenna that radiates 5 GHz waves, and be served as reflectors for each other. The configuration allows the electromagnetic waves to be radiated over wider space, for example near 360-degree space. As shown in the figure, the antenna unit 701, at the left side of the diagram, radiates signals toward the antenna unit 702 at the right side in right direction. Then the waves are reflected by the antenna unit 702. Also, the radiation from the antenna unit 702 is reflected by the antenna unit 701 for wider radiation. The assembly forms a monopole antenna.

Figure 8:
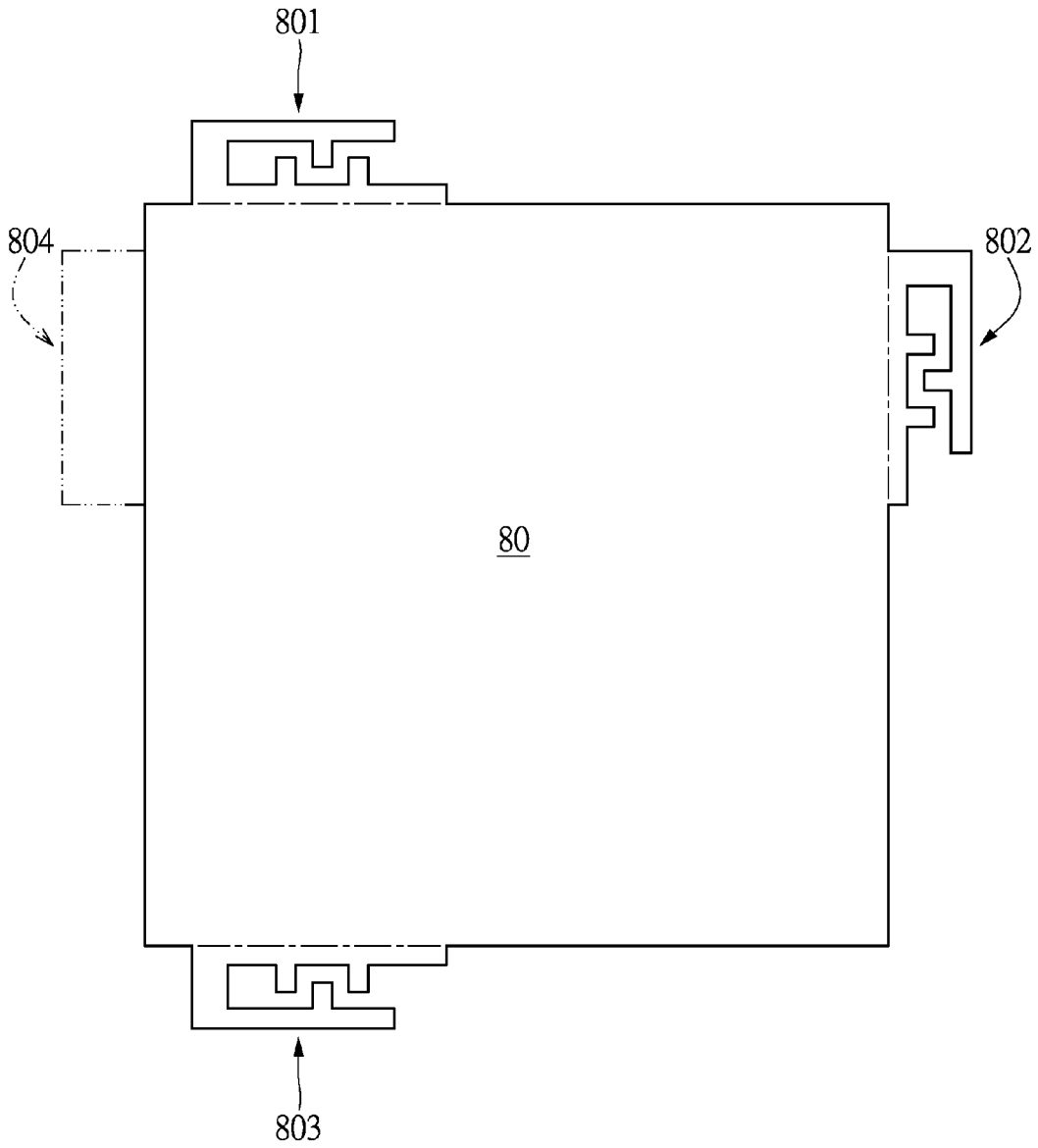
FIG. 8 shows another example of the omnidirectional antenna of the present invention.

Reference is next made to FIG. 8 depicting the embodiment of 顯 the omnidirectional antenna. Three antenna units 801, 802 and 803 are disposed at three sides of the grounded substrate 80. The three antenna units 801, 802 and 803 may be the same type of antennas and individually radiate or receive electromagnetic waves to specific directions. For example, the each antenna unit is in charge of radiating or receiving waves over near 120-degree space.

In the present example, the antenna units 801 and 803 are oppositely disposed, coupled and served as reflectors for each other. The coverage made by this pair of antenna units 801 and 803 may be wider. Additionally, a reflection plate 804 is introduced to be disposed at opposite side to the antenna unit 802 if there is no any antenna unit over there, and used for reflecting the radiation made by the antenna unit 802. The reflection plate 804 is a dummy plate serving as an antenna unit. Therefore, the assembly of the components 801, 802, 803 and 804 accomplishes an omnidirectional antenna. A monopole antenna is described here.

Figure 9:
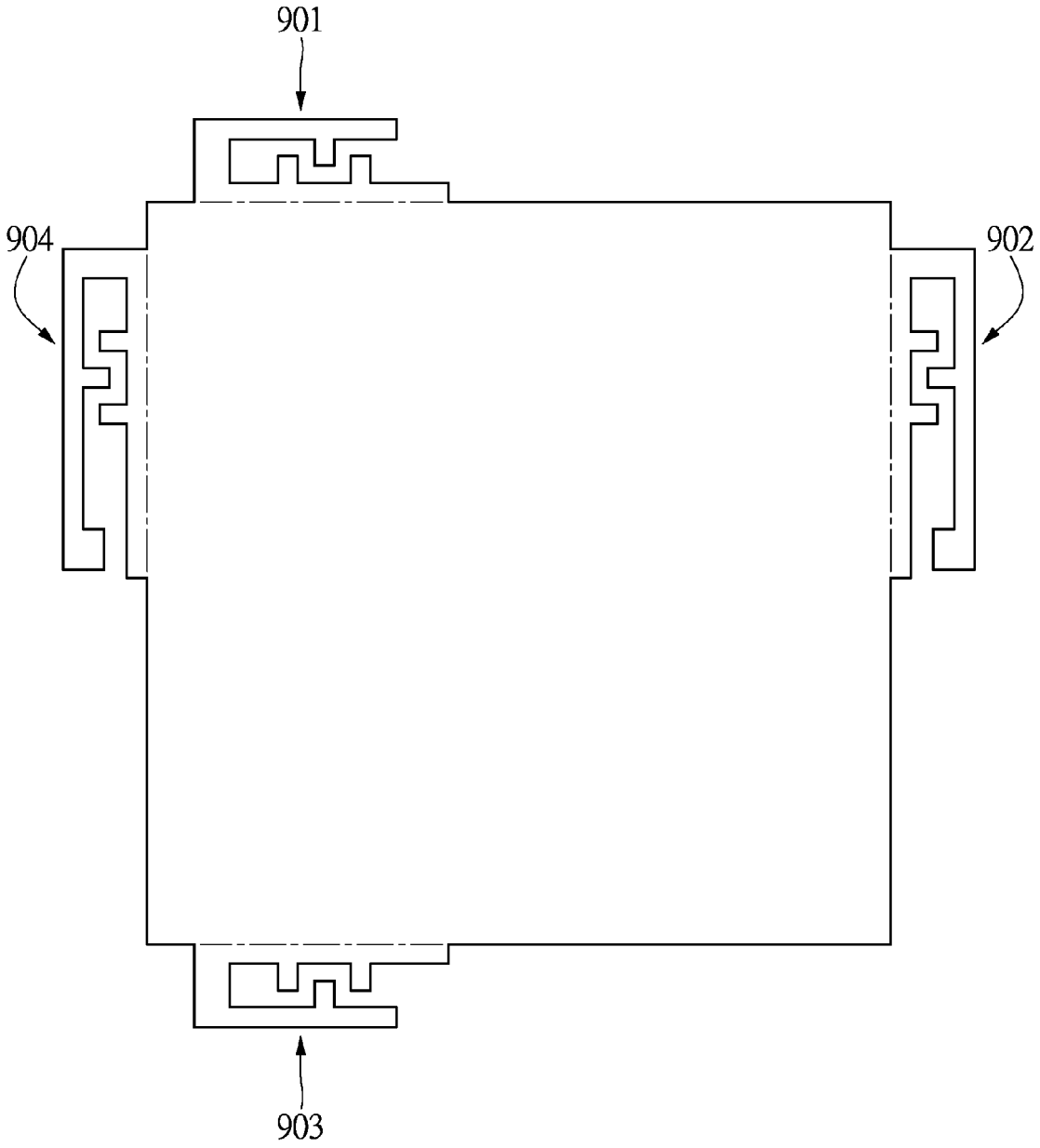
FIG. 9 shows one further example of the omnidirectional antenna of the present invention.

FIG. 9 shows a schematic diagram of the omnidirectional antenna in one embodiment of the present invention.

Multiple antenna units 901, 902, 903 and 904 are disposed at the four sides of substrate. The antenna units 901 and 903 are mutually coupled, and are reflectors for each other. The set of antenna units 901 and 903 is also used to serve the electromagnetic waves over a specific frequency band. The every antenna unit may be in charge of radiating or receiving signals in near 180-degree space. Similarly, the antenna units 902 and 904, individually serves near 180-degree space radiation, are the same type of antennas, and are coupled and served be reflectors for each other. The assembly of the antenna units 901, 902, 903 and 904 form a dipolar omnidirectional antenna.

Figure 10:
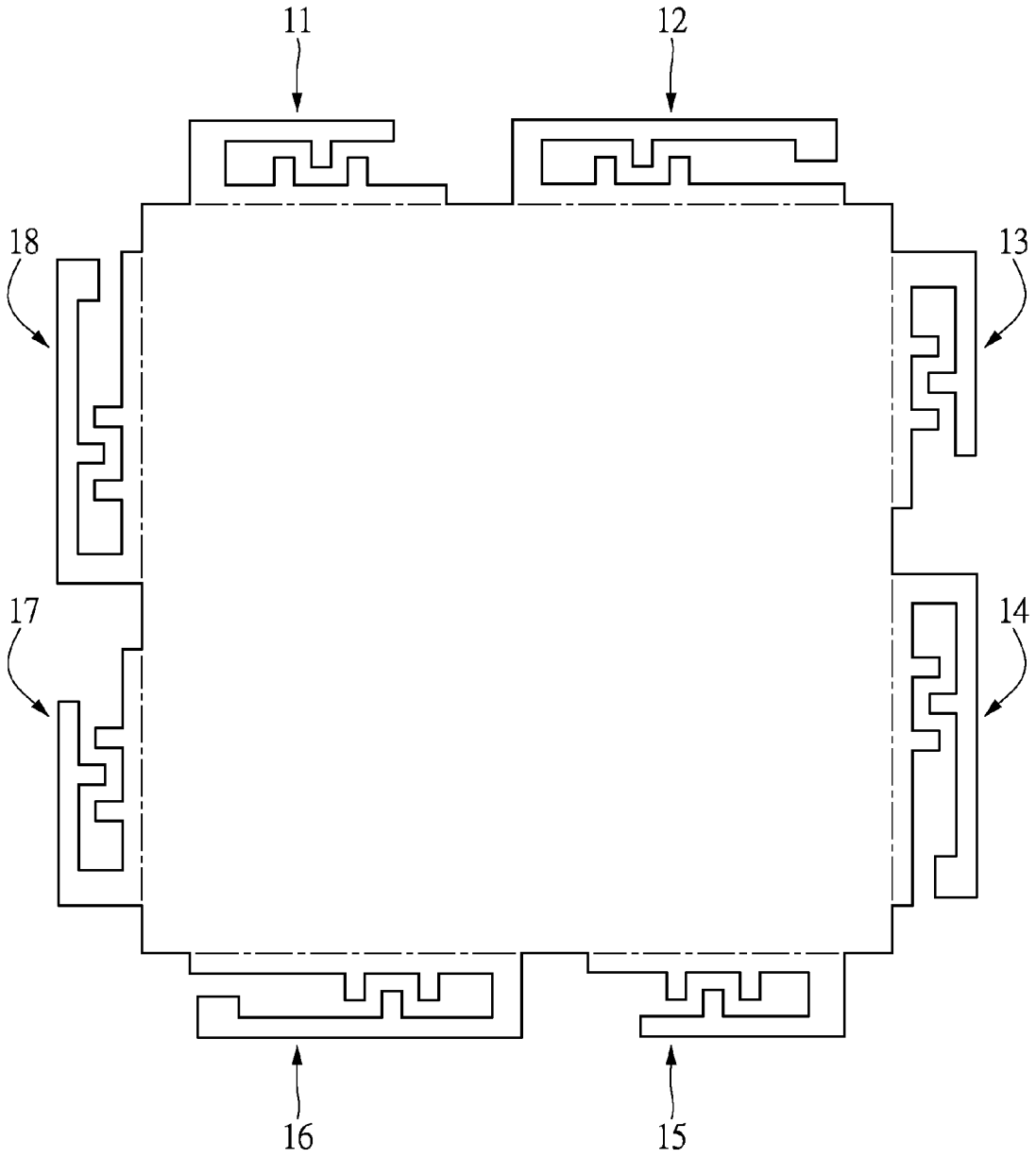
FIG. 10 shows one further example of the omnidirectional antenna of the present invention.

One further embodiment of the omnidirectional antenna is schematically depicted in FIG. 10. The four sides in the peripheral region of the plane substrate are uniformly disposed with antenna units 11, 12, 13, 14, 15, 16, 17 and 18. These antenna units may be categorized into at least two types of antenna units. These two types of antenna units are alternately disposed in the peripheral region of the substrate. For example, the antenna units 11, 13, 15 and 17 are the same type of antenna and used to operate over the same frequency band. The antenna units 11, 13, 15 and 17 are coupled mutually. The each of the antenna units 11, 13, 15 and 17 is in charge of radiating or receiving signals over near 90-degree space. Similarly, the antenna units 12, 14, 16 and 18 are the set with the same type of antenna. The antenna units 12, 14, 16 and 18 operate the signals in the same frequency band. The each of the antenna units 12, 14, 16 and 18 is in charge of radiating or receiving signals over near 90-degree space. The assembly of the units forms a dipolar antenna for simultaneously processing the RF signals in at least two frequency bands.

The opposite antenna units are served as reflectors for each other. For example, the antenna unit 11 and its opposite antenna unit 16 may be different types of antenna units. The antenna unit 11 reflects the waves made by the antenna unit 16. The antenna unit 16 also reflects the signals from the antenna unit 11. The every two opposite antenna units (12, 15) (13, 18) (14, 17) serve as reflectors in pairs.

Figure 11:
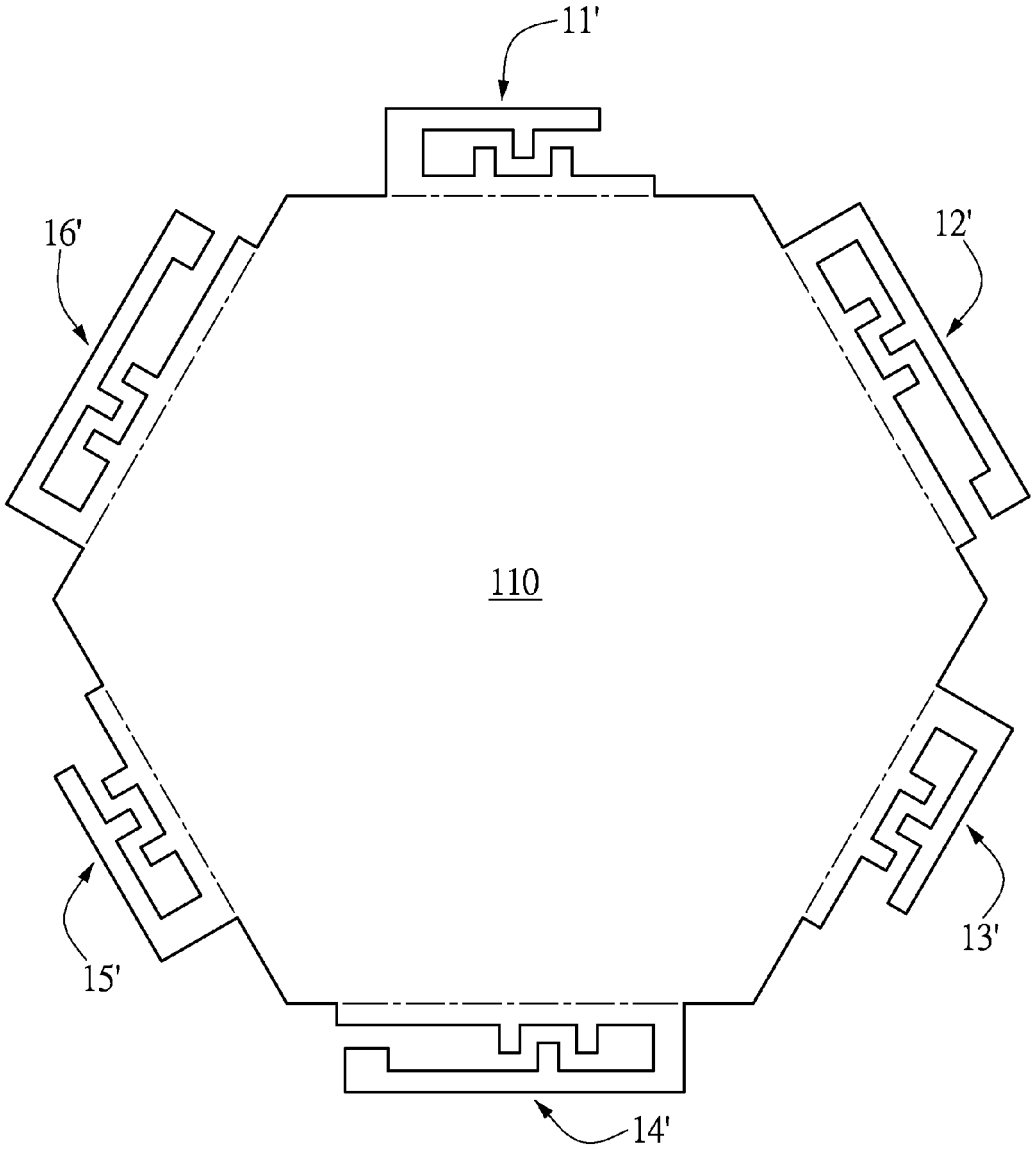
FIG. 11 shows a diagram depicting the omnidirectional antenna in second embodiment of the present invention.

The substrate, in an exemplary embodiment, may be hexagonal. FIG. 11 shows a second embodiment of the present invention.

FIG. 11 shows a grounded antenna with hexagonal substrate 110. Six antenna units 11', 12', 13', 14', 15' and 16' in peripheral region of the substrate 110 are oppositely disposed in pairs. The each antenna unit is the structured extended from the edge of substrate 110. There are at least two types of antenna units are disposed in the peripheral region, reference is made to FIG. 10.

In the present example, the antenna unit and its adjacent antenna unit or its opposite antenna unit operate the signals in different frequency bands. For example, the antenna unit 11' is at one side of the hexagonal substrate 110, and operating around a first frequency band. The first frequency band is around 2.4 GHz. Another antenna unit 14' is at opposite side to the antenna unit 11'. The antenna unit 14' operates in second frequency band, for example in band 5 GHz. The antenna unit 12' next to the antenna unit 11' operates in the second frequency band. These antenna units operating around the second frequency band are alternately disposed among the antenna units in the first frequency band. The multiple antenna units are oppositely disposed at the substrate in pairs, and are served as reflectors for each other.

Figure 12:
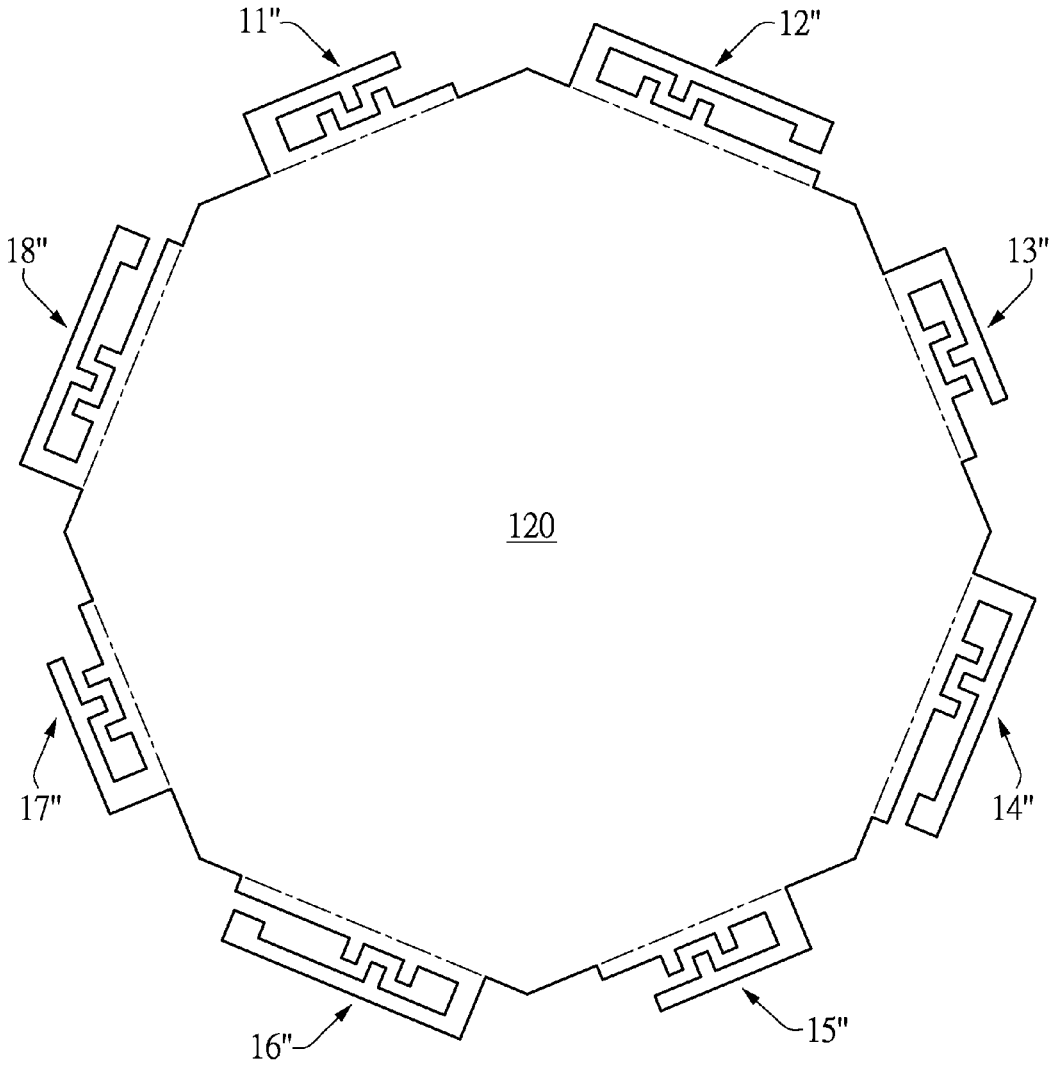
FIG. 12 shows a diagram depicting the omnidirectional antenna in third embodiment of the present invention.

FIG. 12 schematically illustrates an omnidirectional antenna in third embodiment of the present invention.

The main body of antenna is a substrate 120, on which multiple antenna units 11", 12", 13", 14", 15", 16", 17" and 18" are disposed in peripheral region of the substrate 120. The adjacent antenna units are for two different frequency bands, such as in a first frequency band and in a second frequency band. The antenna includes antenna units in the first frequency band such as around 2.4 GHz, and at least one antenna unit in the second frequency band around 5 GHz. The antenna units are the structure extended from the edge of substrate 120. The types of the antenna units may be referred to the embodiment described in FIG. 10 that shows at least two types of the antenna units.

The adjacent two antenna units serve different frequency bands. The two opposite antenna units, for example the antenna units 11" and 15", are preferably serving the same frequency band. The oppositely disposed antenna units are served as reflectors in pairs.

FIGS. 13 through 24 show the charts illustrating reflection coefficient indicative of performance of omnidirectional antenna in every frequency band. It is shown that the omnidirectional antenna performs well in at least two frequency bands.

In the technical field of antenna, S-parameters, including S11 data, describe the input-output relationship between ports in an antenna system. S11 represents how much power is reflected from the antenna, and is known as the reflection coefficient or return loss.

For example, a network analyzer is used to measure the loss in dB value and impedance. The lower the return loss is, the lower the reflection of antenna is, and it shows the greater radiation power. The charts show the ratio S11 in dB of the reflective waves and incident waves of the every antenna unit.

By the charts, the reflection coefficient in every frequency band is used to determine if the loss of antenna meets the requirement in the specific frequency band. It is used to judge whether or not the antenna is applicable to the specific frequency band.

Figure 13:
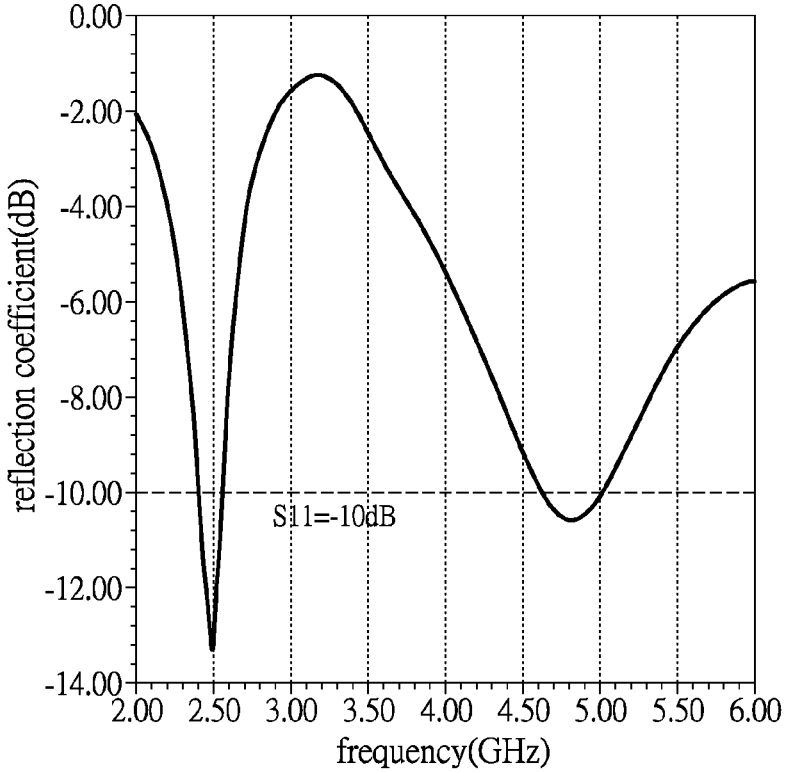
FIGS. 13-24 show the charts illustrating reflection coefficients of the omnidirectional antenna in the various frequency bands based on the present invention.
Figure 14:
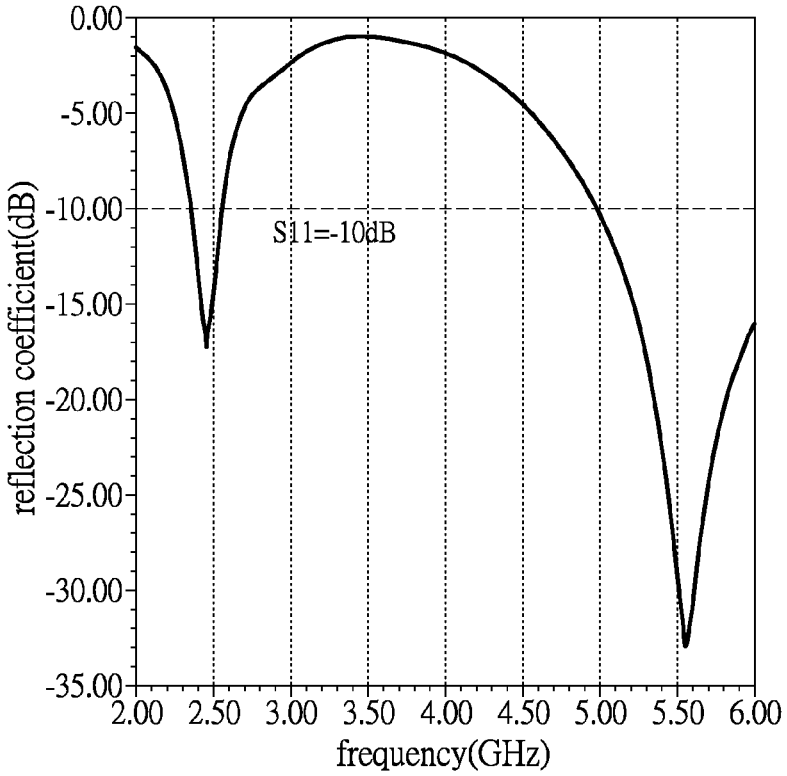
Figure 15:
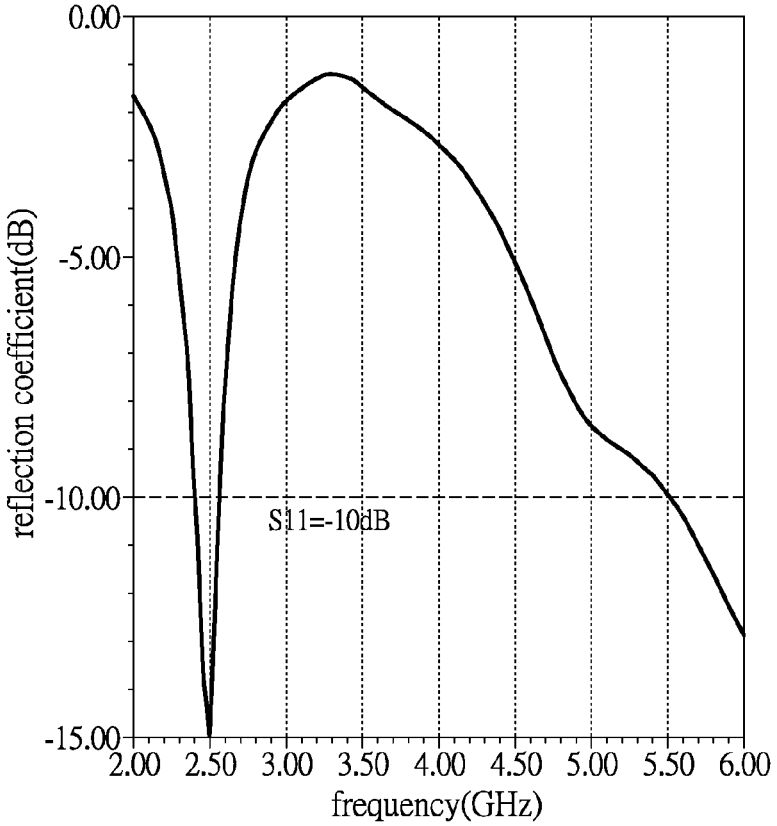

The charts shown in FIGS. 13 to 15 appear the characteristics of the antenna unit by the reflection coefficient. The type of antenna unit is such as the unit described in FIG. 5. An obvious wave trough (lower than −10 dB) near 2.4 GHz is shown, and it appears that the antenna unit has lowest return loss around 2.4 GHz. This type of antenna unit may convey higher radiation power in this frequency band.

Figure 16:
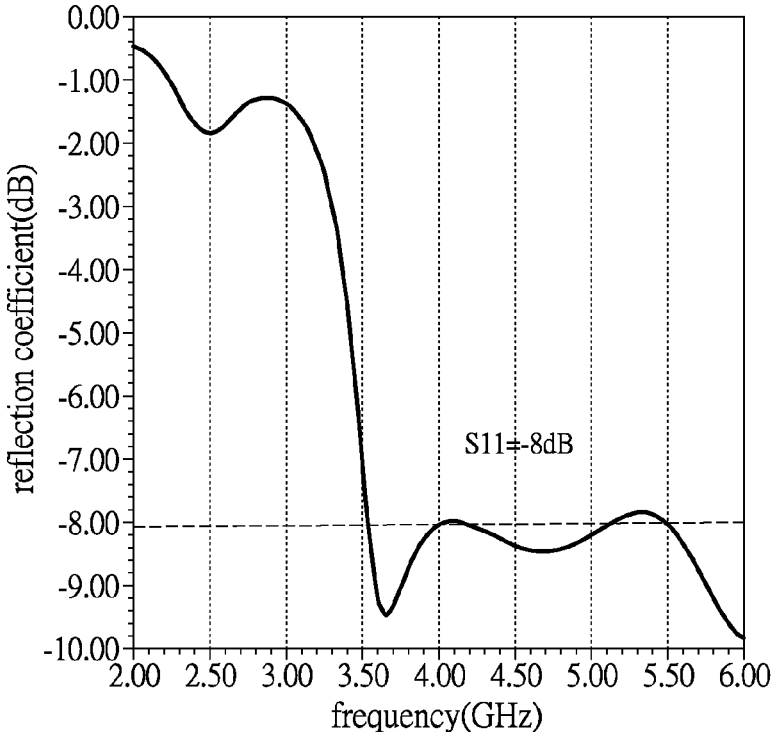
Figure 17:
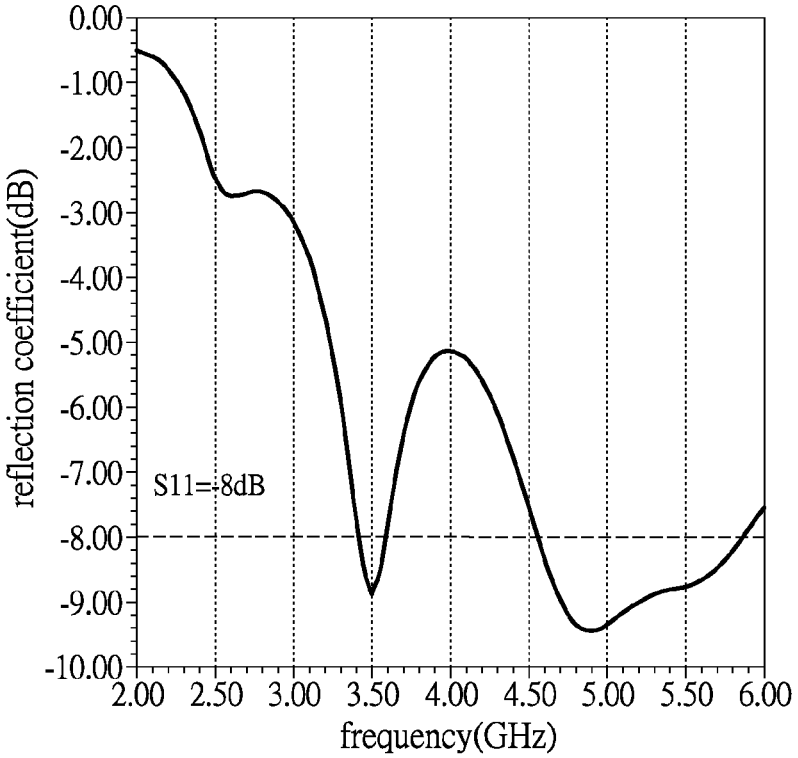
Figure 18:
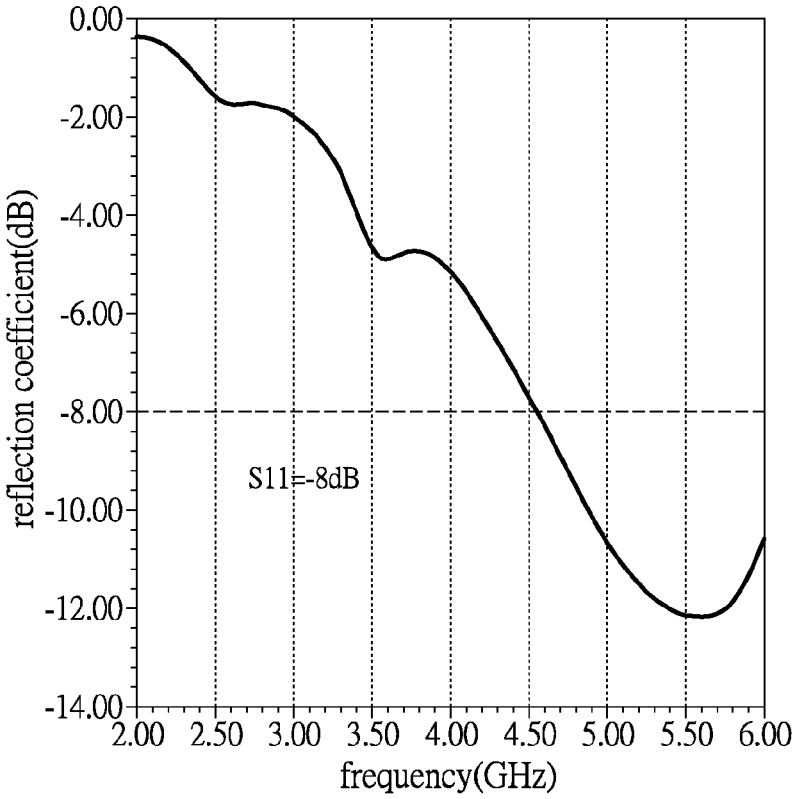

Next, the curves shown in FIGS. 16 to 18 represent the behavior of reflection coefficient in higher frequency. The experiment result shows the return loss of the omnidirectional antenna is lower than −8 dB around 5 GHz even though the return loss shows no significant performance around this frequency band. However, it shows the antenna may operate well in 5 GHz since the reflection coefficient appears to be lower than −8 dB.

To meet the requirement that the omnidirectional antenna needs to operate in dual frequencies, at least two types of antenna units for operating in at least two different frequency bands are provided. The design also shows the two types of antenna units are alternately formed in the peripheral region of substrate for simultaneously processing the RF signals in both 2.4 GHz and 5 GHz. For example, one 5 GHz antenna unit is positioned between two 2.4 GHz antenna units.

The omnidirectional antenna embodies a dipolar antenna which simultaneously operates in two different frequency bands without cross interference. However, if the antenna designed to operate in two or more different frequency bands within a restricted space, the antenna components may be coupled resulting in interference. Signal isolation there-between is one of factors that need to be considered.

Isolation made between the different types of antenna units within the antenna system is referred to the curves indicating the reflection coefficient under an isolation simulation shown in FIGS. 19 to 24.

Figure 19:
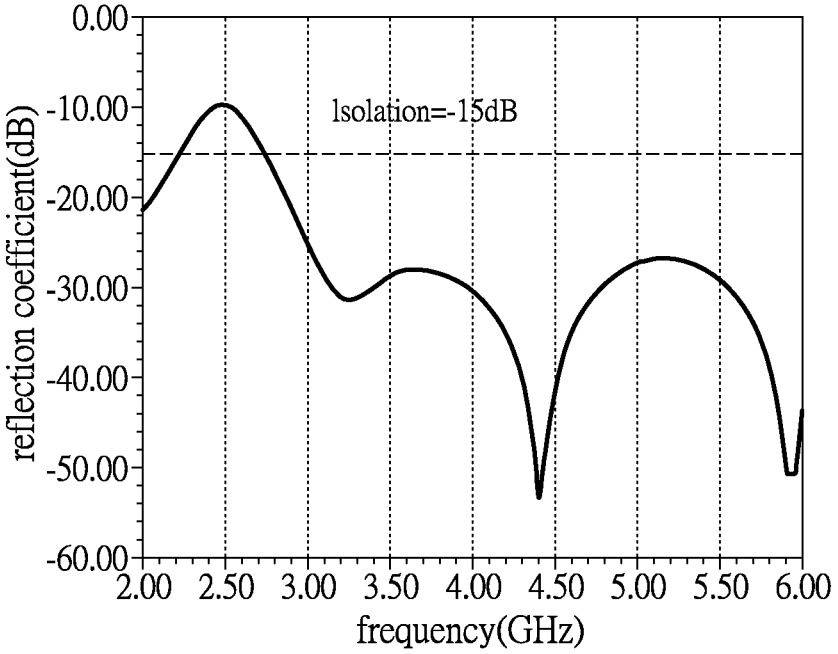
Figure 20:
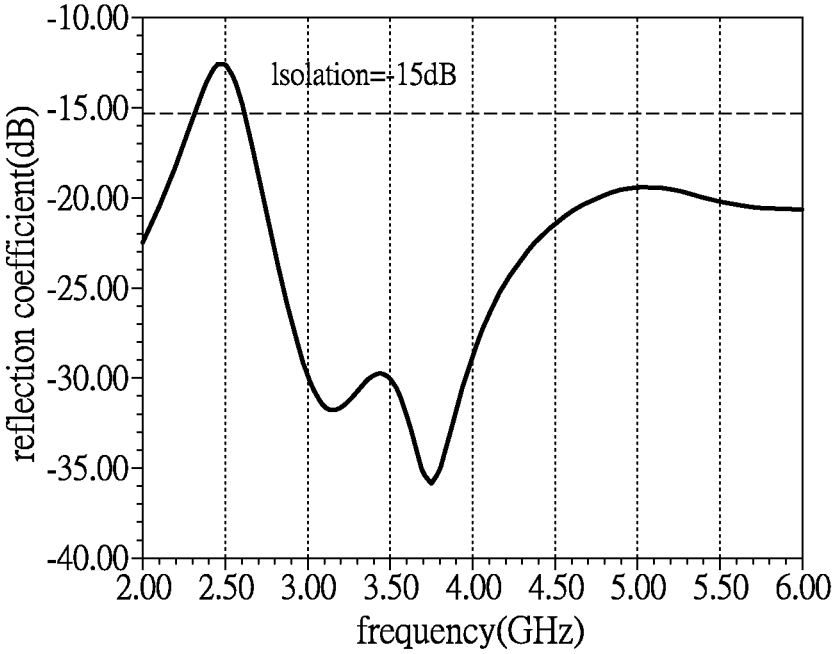
Figure 21:
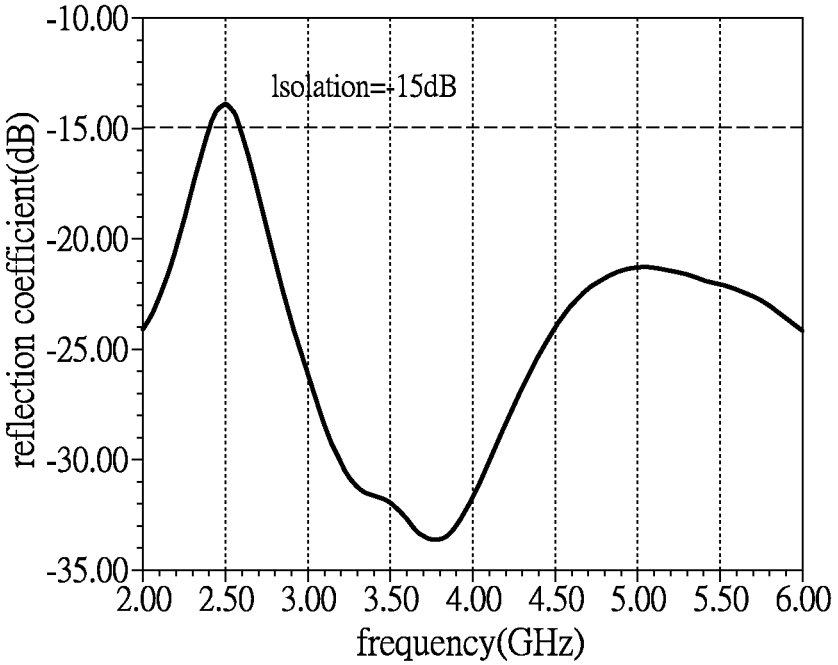

FIGS. 19 to 21 show the return loss in dB value of the antenna units around 2.4 GHz. The return loss between the antenna units indicates the isolation there-between. The figures show the isolation near 2.4 GHz is higher than −15 dB that meets the requirement for isolation. The experiment gave the proof the design may eliminate the interference from the other frequency band. The antenna units with different types are alternately disposed, such as the description in FIG. 5, it means the antenna unit has different type from the adjacent one.

Figure 22:
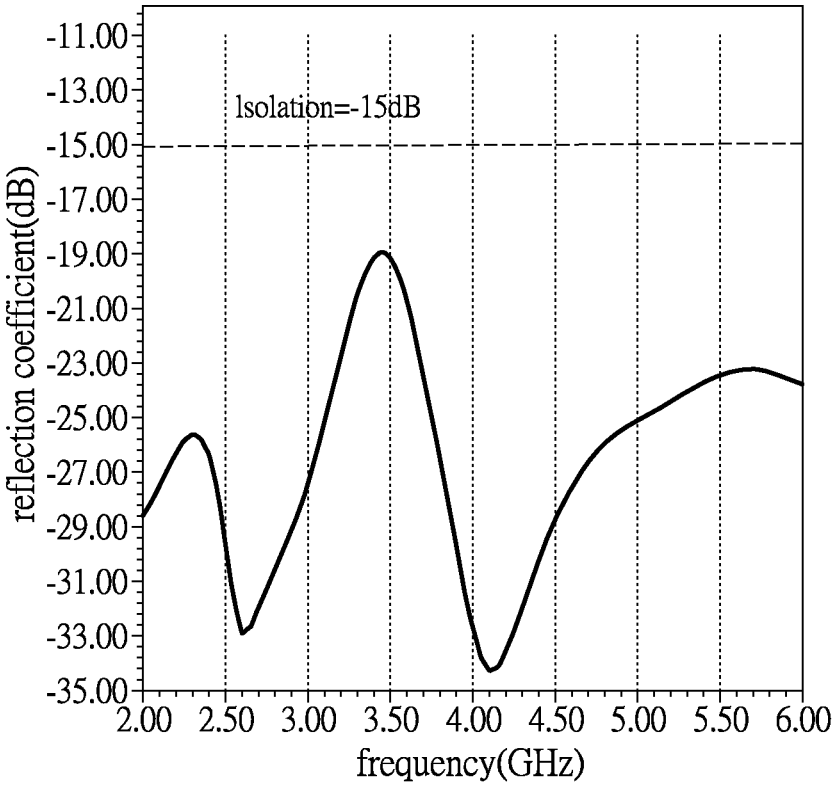
Figure 23:
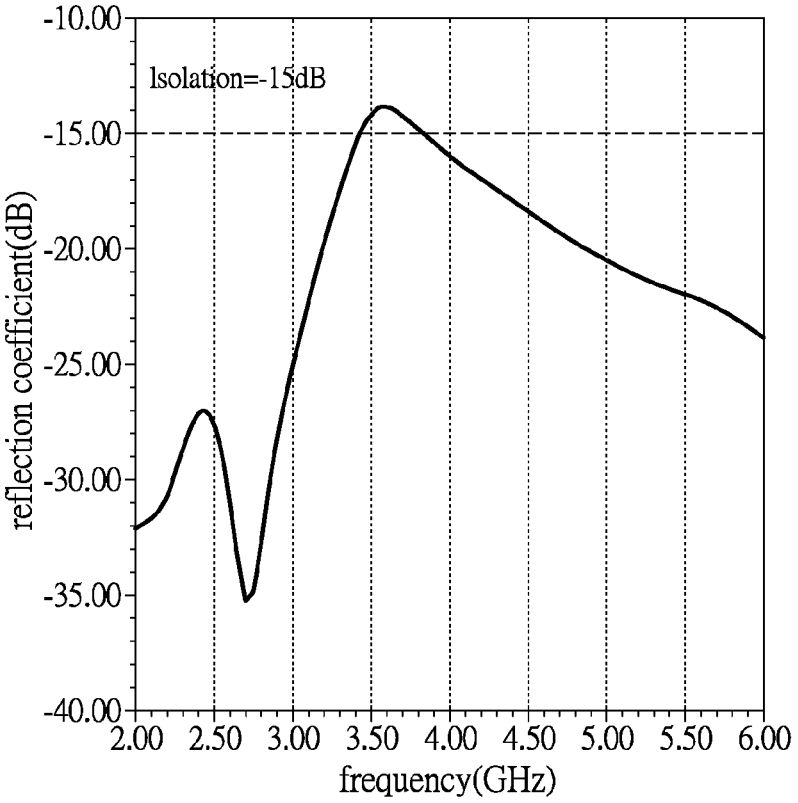
Figure 24:
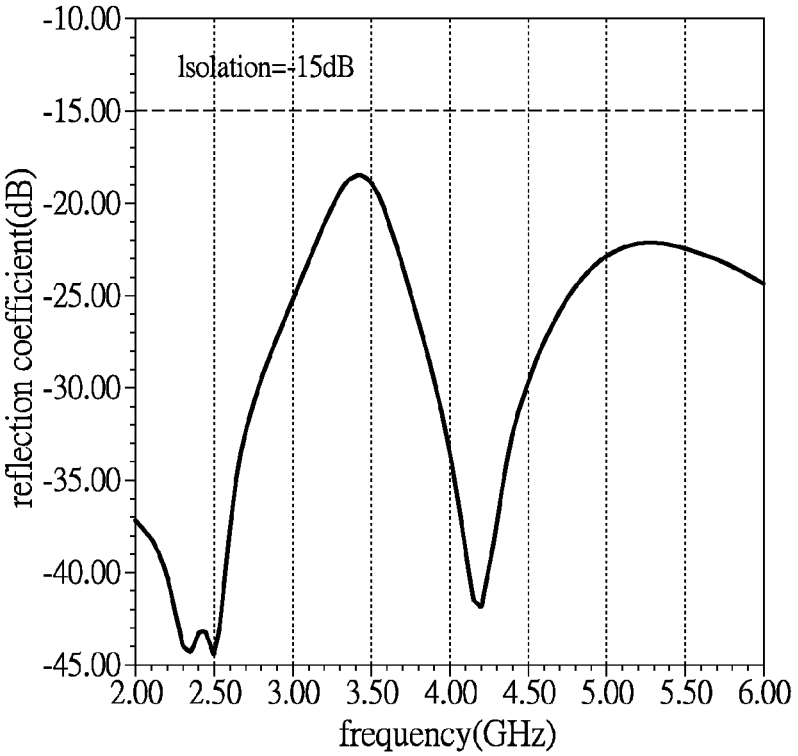

Next, FIGS. 22 to 24 show the behaviors of reflection coefficient of the antenna around 5 GHz. It shows the return loss around 5 GHz may be not good as the behavior around 2.4 GHz, but it still shows the isolation allows the antenna to well operate around 5 GHz. The range in higher frequency band shows great isolation, which means the antenna may work normally in the high frequency since it renders great isolation.

Thus, the omnidirectional antenna in accordance with the present invention is configured to dispose the antenna units in opposite sides of the polygonal substrate. The each antenna unit may operate in a specific frequency band, and also serve as a reflector for its opposite unit. One-piece manufacture is incorporated to making this omnidirectional antenna since it is made by a metal plate. The structure meets the requirements such as miniaturization, thin and low cost. The antenna may serve one or more frequency bands. The experimental data also proves the omnidirectional antenna can operate as a monopole or dipolar antenna normally in specific frequency bands.

It is intended that the specification and depicted embodiment be considered exemplary only, with a true scope of the invention being determined by the meaning of the following claims.

What is claimed is:

1. An omnidirectional antenna, comprising:

a substrate, which is a grounded plane substrate;

a plurality of antenna units disposed in a peripheral region of the substrate, wherein, there are two different types of antenna units including a first type of antenna unit and a second type of antenna unit alternately disposed at the peripheral region of the substrate, and the two types of antenna units served as reflectors for each other are oppositely disposed at the substrate in pairs and respectively operated to receive and transmit electromagnetic waves in two frequency bands; each type of antenna unit comprises:

a strip-shaped radiating member formed in an upper half of the antenna unit, and extended from an inverse-F portion;

a downward-protrudent feeding member formed in a middle portion of the radiating member;

a connecting member formed in a lower half of the antenna unit, being a member interconnecting the antenna unit and the substrate, and connected with the radiating member; and at least two upward-protrudent grounding members formed on the connecting member, and jointly grounded with the substrate through the connecting member, wherein the feeding member is extended to a portion between the two grounding members;

wherein the second type of antenna unit further comprising a protrusion protrudingly formed from an end of the strip-shaped radiation member of the second type of antenna unit.

2. The omnidirectional antenna according to claim 1, wherein the radiating member, the feeding member, the connecting member, and the at least two grounding members of the antenna unit are substantially coplanar.

3. The omnidirectional antenna according to claim 2, wherein, one or more sides of the substrate disposes one or more matching members.

4. The omnidirectional antenna according to claim 2, wherein each antenna unit is substantially perpendicular to the substrate.

5. The omnidirectional antenna according to claim 1, wherein the two frequency band are respectively around 2.4 GHz and 5 GHz.

6. The omnidirectional antenna according to claim 1, wherein the two oppositely disposed antenna units are the same type or different types of antenna units.

7. The omnidirectional antenna according to claim 1, wherein, a reflection plate is introduced to be disposed at opposite side of the antenna unit at the substrate if there is no any antenna unit disposed at the opposite side of the antenna unit.

8. An omnidirectional antenna, comprising:

a substrate, being a ground plane substrate;

a first set of antenna units operating around a first frequency band, electrically connected with the substrate;

a second set of antenna units operating around a second frequency band, electrically connected with the substrate, wherein the second set of antenna units are disposed at peripheral region of the substrate and alternately arranged with the first set of antenna units, so as to render the first set of antenna units and the second set of antenna units to be mutual reflectors; in which, there are two different types of the first set of antenna units and the second set of antenna units, including a first type of antenna unit and a second type of antenna unit, which are alternately disposed at the peripheral region of the substrate, and the two types of the first set of antenna units and the second set of antenna units served as reflectors for each other are oppositely disposed at the substrate in pairs and respectively operated to receive and transmit electromagnetic waves in two frequency bands;

wherein, each antenna unit comprises:

a strip-shaped radiating member formed in an upper half of the antenna unit, and extended from an inverse-F portion;

a downward-protrudent feeding member formed in a middle portion of the radiating member;

a connecting member formed in a lower half of the antenna unit, being a member interconnecting the antenna unit and the substrate, and connected with the radiating member; and at least two upward-protrudent grounding members formed on the connecting member, and jointly grounded with the substrate through the connecting member, wherein the feeding member is extended to a portion between the two grounding members;

wherein the second type of antenna unit further comprising a protrusion protrudingly formed from an end of the strip-shaped radiation member of the second type of antenna unit.

9. The omnidirectional antenna according to claim 8, wherein the radiating member, the feeding member, the connecting member, and the at least two grounding members of the antenna unit are substantially coplanar.

10. The omnidirectional antenna according to claim 9, wherein, one or more sides of the substrate disposes one or more matching members.

11. The omnidirectional antenna according to claim 9, wherein each antenna unit is substantially perpendicular to the substrate.

12. The omnidirectional antenna according to claim 8, wherein the first frequency band and the second frequency band are respectively around 2.4 GHz and 5 GHz.

* * * * *